US008588455B2

(12) United States Patent
Dallas

(10) Patent No.: US 8,588,455 B2
(45) Date of Patent: Nov. 19, 2013

(54) APPARATUS AND METHOD FOR PREVENTING TANGLING FOR WIRED EARPHONES

(76) Inventor: William Dallas, Prairie Grove, IL (US)

( * ) Notice: Subject to any disclaimer, the term of this patent is extended or adjusted under 35 U.S.C. 154(b) by 246 days.

(21) Appl. No.: 13/043,029

(22) Filed: Mar. 8, 2011

(65) Prior Publication Data

US 2012/0230533 A1 Sep. 13, 2012

(51) Int. Cl.
*H04R 25/00* (2006.01)

(52) U.S. Cl.
USPC ..... 381/383; 181/135

(58) Field of Classification Search
USPC ..... 181/131, 135, 129; 381/370, 379, 383, 381/301, 334; 379/438; 455/575.2
IPC .... H04R 1/1033,1/10, 25/00, 5/00, 5/03; H04M 1/15, 1/05, 1/6058, 1/6041; H02G 11/00
See application file for complete search history.

(56) References Cited

U.S. PATENT DOCUMENTS

| | | | | | |
|---|---|---|---|---|---|
| 2,142,407 | A | * | 1/1939 | Norton et al. | 181/135 |
| 3,086,610 | A | * | 4/1963 | Hass | 181/135 |
| 4,064,965 | A | * | 12/1977 | Brown | 181/131 |
| 5,367,345 | A | * | 11/1994 | da Silva | 351/123 |
| 6,233,345 | B1 | * | 5/2001 | Urwyler | 381/381 |
| 7,086,512 | B2 | | 8/2006 | Shack et al. | |
| 2005/0123164 | A1 | | 6/2005 | Yao et al. | |

* cited by examiner

*Primary Examiner* — Curtis Kuntz
*Assistant Examiner* — Sunita Joshi
(74) *Attorney, Agent, or Firm* — Clifford Kraft

(57) ABSTRACT

An earphone wire cover with three separate arms resembling drinking straws joined together in a Y-configuration into which the ear phone speakers and plug are inserted and passed through. These covers enclose most of the wire from the electronic device to the earphones. The three sections are joined together with a flexible tape or string so that, when the earphones are to be stored, the three arms can be brought together as three parallel tubes holding the bulk of the wire by simply flipping the bottom section into alignment with the upper two sections. The invention can be easily re-deployed by simply folding the bottom section out again and separating the top ends to make a Y. An alternate embodiment of the invention can have a microphone hole in one of the arms.

20 Claims, 4 Drawing Sheets

APPARATUS AND METHOD FOR PREVENTING TANGLING FOR WIRED EARPHONES

BACKGROUND

1. Field of the Invention

The present invention relates generally to the field of preventing tangle in wired devices and more particularly to an apparatus and method that prevents tangling of cables associated with wired earphones.

2. Description of the Prior Art

Many present day devices have plug-in wired earphones. Particularly prevalent is the iPod™, iPhone™ and iPad™ sold by Apple Corporation. Unfortunately, the cables on the earphones of these devices have a tendency to become totally tangled almost every time they are put away. Most people simply wrap the wires in a ball and put them in their pocket. When they pull them out, the wires are hopelessly tangled, sometimes taking several minutes to straighten out. It is possible to wind the wires around the device, but they tend to slip off and still become tangled. It would be advantageous to have an apparatus and method to prevent this tangling.

It is known in the art to provide cases for headphones where the wires are wound up after use; however, these are bulky and don't universally handle different types and sizes of earphones. For example, Shack et al., in U.S. Pat. No. 7,086,512, teach a wind-up single earphone in a case where the cable is pulled out of the case for use under spring tension. This requires the case and earphone to be supplied together, and does not provide well for two earphones.

Yao et al., in U.S. Publication number 2005/0123164, teach a mobile device cold holder similar to hand reels for fishing known in the art. This device is bulky and tends be become separated from the earphone. This method is also difficult to use with two earphones.

It would be extremely advantageous to have an apparatus that would prevent tangling during use and then simply fold up with the earphones when not in use continuously preventing tangling in storage.

SUMMARY OF THE INVENTION

The present invention relates to an earphone wire cover with three separate arms of hollow tubing resembling drinking straws joined together in a Y-configuration into which the ear phone speakers and plug are inserted and passed through. These covers enclose most of the wire from the electronic device to the earphones. The three sections are connected with a flexible strap or string so that when the earphones are to be stored, the three arms can be brought together as three parallel tubes holding the bulk of the wire by simply flipping the bottom section into alignment with the upper two sections. The invention can be easily re-deployed by simply folding the bottom section out again and separating the top ends to make a Y.

DESCRIPTION OF THE DRAWINGS

Attention is now directed to several drawings which illustrate features of the present invention.

Several drawings and illustrations have been provided to aid in understanding the present invention. The scope of the present invention is not limited to what is shown in the figures.

DESCRIPTION OF THE INVENTION

Figure 1:
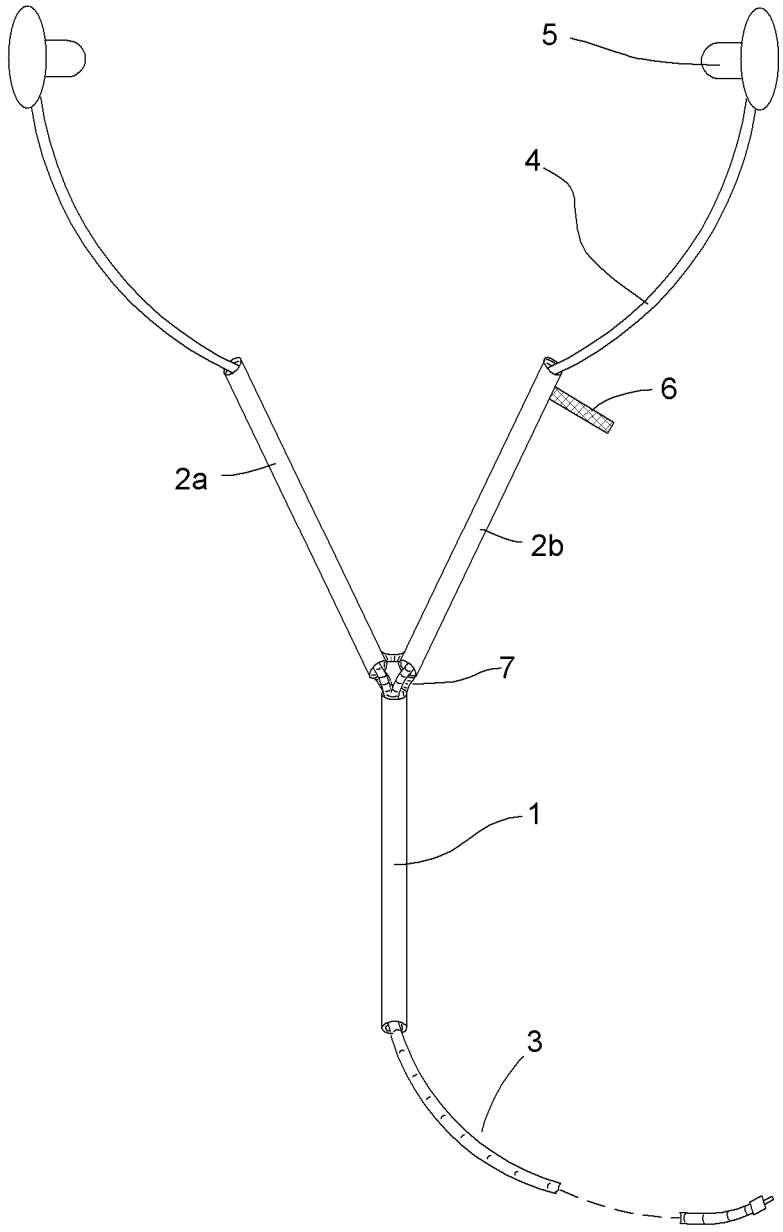
FIG. 1 is a front view of an embodiment of the present invention showing it containing a pair of earphones.

The apparatus of the present invention contains three connected hollow arms that resemble drinking straws. The three arms are connected by a flexible member such as tape, a strap, a string or by any flexible connecting method so that the three tubes can take a Y-configuration. The connecting tape acts as a hinge. An embodiment of the invention is shown in FIG. 1 including a pair of earphones. The lower legs 1 and the upper legs 2*a*, 2*b* are connected with a flexible member 7 so that they are hinged together, but otherwise free to move. The lower earphone cable 3 is inserted into the lower arm 1 and worked all the way through. The arms are generally made from a stretchable, elastic material that will allow passage of a larger piece such as the earphone plug and the earphone speakers. Each earphone speaker 5 is inserted and pushed through one of the upper arms 2*a* or 2*b* until the configuration shown in FIG. 1 is reached with the earphone cables 4 free to run up to a user's ears. FIG. 1 is the standard use configuration for the invention.

Figure 2:
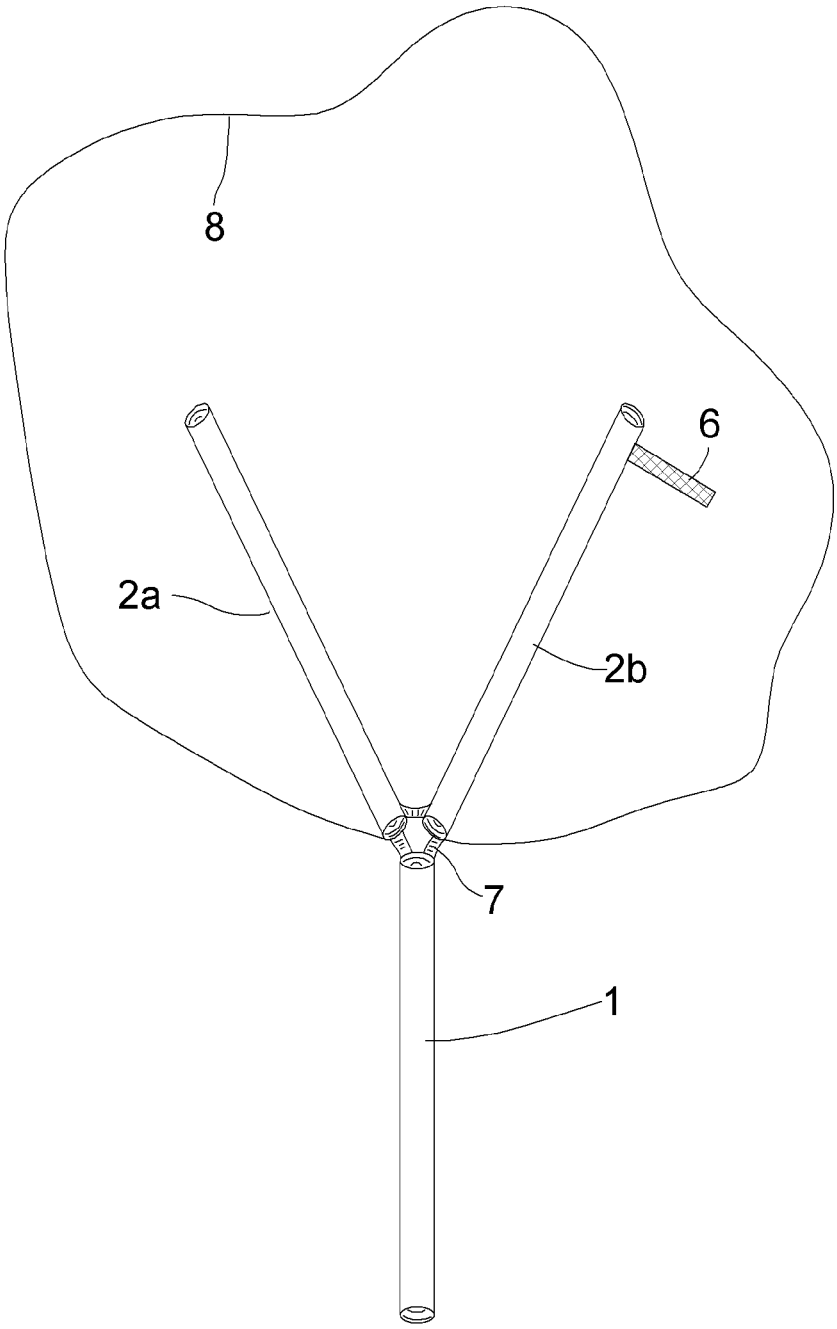
FIG. 2 is a front view of the embodiment of FIG. 1 without the earphones.

FIG. 2 shows the embodiment of FIG. 1 without the earphones. In addition to the arms 1, 2*a*, 2*b*, an optional neck cord 8 is shown. This neck cord can fit around the user's neck to support the invention and take any weight off the ears. Further, the neck cord is very useful when the wearer wants to engage in conversation with another person. The earphones can be removed from the ear so the wearer can hear the person he or she is speaking to without having to hold or fold up the earphones. Without the neck cord, the earphones would fall to the ground when removed from the ear. With the neck cord, the earphones remain affixed to the neck and are ready to be reinserted into the ear when the conversation ends.

FIGS. 1-2 also show a piece of hook/loop strap 6, like strap sold under the trademark VELCRO™. This strap can be two-sided. This hook/loop strap can be used to hold the three arms together in the folded configuration.

Figure 3:
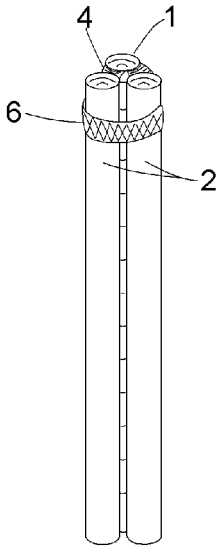
FIG. 3 is a view of an embodiment of the invention folded for storage.

FIG. 3 shows the configuration of the three arms 1, 2 in the folded or parallel configuration. The top arm 1 is simply flipped over on its connecting member 4 and then bundled with the other two arms 2 using the hook/loop strap 6 to hold the three arms together. A typical folded configuration of the present invention will also contain the earphone cables and earphones. When the user desires to use the system, the hook/loop strap 6 is released, the lower arm 1 is flipped away from the upper arms; the neck strap 8 (shown in FIG. 2) can be placed around the user's neck, the lower cable plugged into the electronic device, and the earphones placed on the user's ears for listening.

The preferred length of each of the arms 1, 2 is between approximately 12-16 inches in length, but can be longer or shorter depending on the manufacturer of the earphones. The arms are made from hollow tubes of an elastic material. The preferred inside diameter of the openings in each of the arms is approximately ⅛ inch since this is the diameter of standard earphone wire. The arms can be made from any relatively strong elastic material. The wall thickness can be chosen for overall arm flexibility. Thicker materials are more effective at preventing tangling. A preferred material will stretch elastically enough to pass the earphone speaker though it while tightening around the wire after the speaker has passed through. A material like cotton works quite well; however, preferred material is a plastic for ease and cheapness in manufacture.

The flexible tape or string members 7 that tie the three arms 1, 2 together can be made from any strong, flexible material with a flexible cloth or plastic tape being preferred.

The apparatus of the present invention is lightweight, not bulky and fits snugly over the wire preventing the wire from tangling. The material can be any color or texture as long as it is elastic enough to pass the earphone speaker. In some embodiments, the invention can be an avenue for personal expression with users (especially teenagers) being able to choose a variety of colors and designs.

As previously stated, when the device is first purchased, or when the user wishes to put a different pair of earphones into the device, the earphone plug is inserted into and pushed through the lower arm 1. Then, each earphone speaker is inserted and pushed through the upper arms 2. At that point, the invention is ready to use for listening. When it is desired to store the earphones, the lower arm 1 can be flipped up to be parallel with the upper arms 2, and the hook/loop strap 6 is used to wrap and hold the three arms together. To re-deploy the unit, the hook/loop strap 6 is released, the lower arm 1 is flipped downward, and the invention is ready to use for listening, without any cord tangle.

Figure 4:
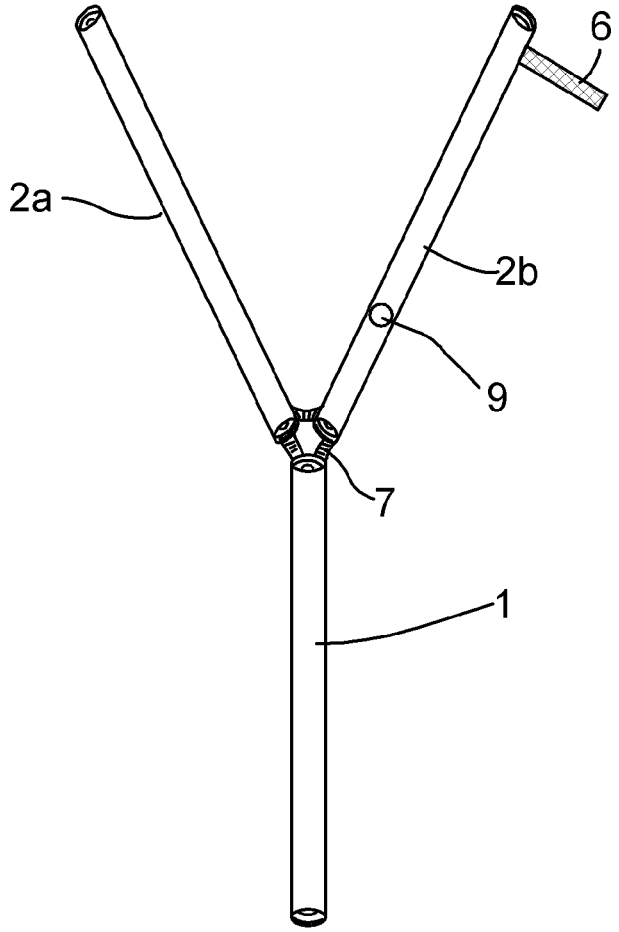
FIG. 4 is the embodiment of FIG. 2 showing a microphone hole.

An alternative embodiment of the present invention show in FIG. 4 can have a microphone hole 9 in one of the arms or at the center of the 3 arms, depending on the placement by the manufacturer. The microphone, can simply be positioned at this hole so it is not blocked by the material of the arms. While FIG. 4 shows the microphone hole in an upper arm, the optional microphone hole can be located anywhere.

Several descriptions and illustrations have been presented to aid in understanding the present invention. One with skill in the art will realize that numerous changes and variations are possible without departing from the spirit of the invention. Each of these changes and variations is within the scope of the present invention.

I claim:

1. A method to prevent tangling of earphone wires comprising:

providing three tubes of substantially equal length formable into a Y-configuration, the Y-configuration having a center point, each tube having a proximal end near said center point and a distal end away from said center point;

attaching the proximal end of each tube to the proximal end of another of said tubes near said center point with a short flexible member, each of said tubes being adapted to allow elastic passage of an earphone plug or earphone speaker from end to end;

allowing said tubes to be pivoted on said flexible member into a configuration where all three tubes are substantially aligned, substantially parallel to one-another and tightly packed together for storage.

2. The method of claim 1 further comprising providing a neck cord attached to at least one of said tubes.

3. The method of claim 1 further comprising providing a hook/loop tie strap attached to at least one of said tubes.

4. The method of claim 1 wherein said short flexible member is a flexible tape.

5. The method of claim 1 wherein said tubes can be supplied in a plurality of colors.

6. The method of claim 1 wherein each of said tubes is between approximately 12 to 16 inches in length.

7. The method of claim 1 wherein each of said tubes has an inside diameter of approximately ⅛ inch.

8. An apparatus that prevents tangling of earphone cords comprising:

three substantially straight tubes configurable in a Y-configuration, said Y-configuration having a center point, each of said tubes having a proximal end near the center point and a distal end away from the center point;

a plurality of flexible attachment members attaching the proximal ends of said tubes together;

wherein, said tubes are adapted to elastically stretch to pass a headphone plug or headphone speaker from end to end;

and wherein said three tubes can be folded on said flexible attachment members to form a parallel-configuration for storage.

9. The apparatus of claim 8 further comprising a hook/loop strap securing said tubes together in said parallel-configuration.

10. The apparatus of claim 8 further comprising a neck strap.

11. The apparatus of claim 8 wherein said flexible attachment members are flexible tape.

12. The apparatus of claim 8 wherein there are three of said flexible attachment members.

13. The apparatus of claim 8 wherein each of said tubes has an inside diameter of approximately ⅛ inch.

14. The apparatus of claim 8 wherein each of said tubes has a length of between approximately 12-16 inches.

15. The apparatus of claim 8 wherein said tubes can be supplied in a plurality of colors.

16. A method of preventing earphone cord tangle comprising:

inserting and passing an earphone plug and cable through a first hollow substantially straight, semi-rigid tube by stretching said tube's diameter;

inserting and passing a first earphone speaker through a second hollow substantially straight, semi-rigid tube by stretching said tube's diameter;

inserting and passing a second earphone speaker through a third hollow substantially straight, semi-rigid tube by stretching said tube's diameter, wherein said first, second and third hollow tubes are flexibly connected at one end formable into a Y-configuration for use with an electronic device;

reconfiguring said first, second and third tubes into a parallel configuration for storage.

17. The method of claim 16 wherein said first, second and third tubes are connected with flexible tape.

18. The method of claim 16 further comprising a neck cord.

19. The method of claim 16 wherein said first, second and third tubes have inside diameters of approximately ⅛ inch.

20. The method of claim 16 wherein said first, second and third tubes have lengths of between approximately 12-16 inches.

* * * * *